US008166785B2

(12) United States Patent
Ootsuka et al.

(10) Patent No.: US 8,166,785 B2
(45) Date of Patent: May 1, 2012

(54) ROLLING MILL APPARATUS AND METHOD OF SHAPE CONTROL OF ROLLED STRIP AND PLATE

(75) Inventors: Hiroyuki Ootsuka, Yokohama (JP); Tsukasa Matsuzawa, Yokohama (JP); Shigeru Tsuzuki, Yokohama (JP); Hisashi Honjou, Yokohama (JP)

(73) Assignees: IHI Corporation (JP); IHI Metaltech Co., Ltd. (JP)

( * ) Notice: Subject to any disclaimer, the term of this patent is extended or adjusted under 35 U.S.C. 154(b) by 426 days.

(21) Appl. No.: 12/516,232

(22) PCT Filed: Nov. 14, 2007

(86) PCT No.: PCT/JP2007/072118

§ 371 (c)(1),
(2), (4) Date: May 26, 2009

(87) PCT Pub. No.: WO2008/065893

PCT Pub. Date: Jun. 5, 2008

(65) Prior Publication Data

US 2010/0064748 A1 Mar. 18, 2010

(30) Foreign Application Priority Data

Nov. 27, 2006 (JP) ..... P2006-318820

(51) Int. Cl.
*B21B 37/00* (2006.01)
*B21B 27/06* (2006.01)

(52) U.S. Cl. ..... 72/11.7; 72/41; 72/43; 72/201; 72/224; 72/236; 72/342.2; 72/342.3; 72/342.7

(58) Field of Classification Search ..... 72/7.4, 72/8.3, 8.6, 9.1, 11.7, 13, 17, 41, 43, 201, 72/224, 225, 236, 241.4, 241.6, 242.2, 250, 72/342.2, 342.3, 342.7, 13.2, 17.2
See application file for complete search history.

(56) References Cited

U.S. PATENT DOCUMENTS 4,612,788 A * 9/1986 Kitagawa ..... 72/11.3
4,750,343 A * 6/1988 Richter et al. ..... 72/11.4
5,235,835 A * 8/1993 Sakai et al. ..... 72/9.1
5,509,285 A * 4/1996 Anbe ..... 72/8.6
6,014,881 A * 1/2000 Imanari ..... 72/201

(Continued)

FOREIGN PATENT DOCUMENTS

JP 4-197507 7/1992

(Continued)

OTHER PUBLICATIONS

Office Action issued Nov. 9, 2009 on Taiwanese Patent Application No. 096144422 with English language translation of Search Report (5 pages).

(Continued)

*Primary Examiner* — David Jones
(74) *Attorney, Agent, or Firm* — Ostrolenk Faber LLP

(57) ABSTRACT

This invention relates to a rolling mill apparatus and a method of shape control of a rolled strip which enables satisfactory shape control even in extremely thin rolling. A rolling mill apparatus of this invention has a rolling mill, which rolls a rolled strip P between upper and lower work rolls; a shape detecting portion, which detects the degree of flatness of the rolled strip in the width direction of rolled strip which has been rolled by the rolling mill; a spray portion, having a plurality of spray nozzles arranged along the length direction of the upper and lower work rolls, which sprays the upper and lower work rolls with coolant C; and, a shape control portion, which adjusts the spray amount and/or temperature of the coolant C sprayed from the spray portion based on detected information from the shape detecting portion, to control the shape of the rolled strip P. The shape control portion has two control modes, in which the relationship of the detected information of the shape detecting portion and the spray amount and/or temperature of the coolant C sprayed from the spray portion are inversely proportional, and switches between these two control modes based on the strip thickness of the rolled strip P.

6 Claims, 3 Drawing Sheets

U.S. PATENT DOCUMENTS

| | | | | |
|---|---|---|---|---|
| 6,314,776 | B1 * | 11/2001 | Puda | 72/10.1 |
| 7,305,859 | B2 * | 12/2007 | Ootsuka et al. | 72/9.1 |
| 8,001,820 | B2 * | 8/2011 | Pawelski et al. | 72/236 |

FOREIGN PATENT DOCUMENTS

| | | |
|---|---|---|
| JP | 10-137831 | 5/1998 |
| JP | 2006-263740 | 10/2006 |
| TW | 445181 | 7/2001 |

OTHER PUBLICATIONS

International Search Report mailed Feb. 12, 2008 in corresponding PCT International Application No. PCT/JP2007/072118.

* cited by examiner

ROLLING MILL APPARATUS AND METHOD OF SHAPE CONTROL OF ROLLED STRIP AND PLATE

CROSS-REFERENCE TO RELATED APPLICATIONS

The present application is a 35 U.S.C. §§371 national phase conversion of PCT/JP2007/072118, filed Nov. 14, 2007, which claims priority of Japanese Patent Application No. 2006-318820, filed Nov. 27, 2006. The PCT International Application was published in the Japanese language.

BACKGROUND OF THE INVENTION

1. Field of the Invention

This invention relates to a rolling mill apparatus and to a method of shape control of a rolled strip.

This application claims priority from Japanese Patent Application No. 2006-318820, filed Nov. 27, 2006, the contents of which are incorporated herein by reference.

2. Description of Related Art

As a method of correcting the shape ("shape" here means both strip flatness and strip crown) of a rolled strip and a rolled plate (hereinafter abbreviated as a rolled strip) in a rolling mill apparatus, a method is known in which work roll cooling fluids (hereinafter abbreviated as a coolant) at, for example, two different temperatures are selected and sprayed onto the upper and lower work rolls.

In this method, by spraying a high-temperature coolant from a plurality of sprayers arranged parallel to the work rolls, and causing an expansion of the roll diameters through the thermal effect thereof, the strip thickness of the rolled strip is reduced. On the other hand, by spraying work rolls with a low-temperature coolant, which causes contraction of the roll diameters, the strip thickness of the rolled strip is increased. By this means, the shape of the rolled strip is adequately controlled (see Patent Document 1).

Patent Document 1: Japanese Unexamined Patent Application No. H 04-197507

DISCLOSURE OF THE INVENTION

Problems to be Resolved by the Invention

However, even when using the above-described technology, in the case of extremely thin rolled strips, when the strip thickness of the rolled strip is less than or equal to the thickness at which the oil film thickness of the rolling lubricant oil including the coolant influences the strip shape, adequate control of the shape is not possible.

That is, a phenomenon is observed in which, when the strip thickness of rolled strip is less than or equal to the thickness at which the oil film thickness of rolling lubrication oil including the coolant, influences the strip shape, if the work rolls are sprayed with a high-temperature coolant, the strip thickness of the rolled strip increases rather than decrease. On the other hand, if the work rolls are sprayed with a low-temperature coolant, the strip thickness of the rolled strip decreases rather than increase.

Hence, there is a problem that satisfactory strip shape control in rolling of an extremely thin strip is not possible.

This invention was devised in light of the above-described problem, and has as an object of providing a rolling mill apparatus and a shape control method for a rolled strip which enable satisfactory shape control even in extremely thin strip rolling.

Means to Resolve the Problems

In order to resolve the above problem in rolling mill apparatus, the following aspects are adopted in a shape control method for a rolled strip of the present invention.

A rolling mill apparatus of a first aspect of the present invention has a rolling mill, which rolls a rolled strip between upper and lower work rolls; a shape detecting portion, which detects the degree of flatness of the rolled strip in the width direction of rolled strip which has been rolled by the rolling mill; a spray portion, having a plurality of spray nozzles arranged along the length direction of the upper and lower work rolls, which sprays the upper and lower work rolls with a coolant; and, a shape control portion, which adjusts the spray amount and/or temperature of the coolant sprayed from the spray portion based on detected information from the shape detecting portion, to control the shape of the rolled strip. The shape control portion has two control modes, in which the relationship between the detected information of the shape detecting portion and the spray amount and/or temperature of the coolant sprayed from the spray portion are inversely proportional, and switching between these two control modes is performed based on the strip thickness of the rolled strip.

According to the present invention, the shape of rolled strip can be controlled by causing expansion and contraction of the roll diameters of the upper and lower work rolls through the thermal effect of coolant sprayed onto the upper and lower work rolls from the spray portion. Furthermore, in order to control the shape of the rolled strip, the effect of the oil film thickness of the coolant formed between the upper and lower work rolls and the rolled strip can also be considered.

Further, the shape control portion of the rolling mill apparatus of the present invention may be capable of switching between the two control modes when the rolled strip has a strip thickness less than or equal to the thickness at which the oil film thickness of the rolling lubrication oil including the coolant influences the strip shape.

By this means, satisfactory shape control can be performed even in an extremely thin rolling region where an influence of the oil film thickness of the rolling lubrication oil including the coolant is large.

Further, the spray portion may be provided with a high-temperature spray nozzle and a low-temperature spray nozzle, which spray coolant at different temperatures. When a convexity in the rolled strip considered to be a change in shape is detected, the shape control portion increases the spraying quantity from the high-temperature spray nozzle. The shape control portion is provided with first and second control modes. The first control mode increases the spraying quantity from the low-temperature spray nozzle when a concavity considered to be a change in shape is detected and increases the spraying quantity from the high-temperature spray nozzle when a convexity considered to be a change in shape is detected. The second control mode increases the spraying quantity from the low-temperature spray nozzle when a convexity of the rolled strip considered to be a change in shape is detected, and increases the spraying quantity from the high-temperature spray nozzle when a concavity considered to be a change in shape is detected.

By this means, in the rolling region in which the effect of the oil film thickness of the rolling lubrication oil including the coolant is almost absent or very small, the first control mode can be used to spray high-temperature coolant onto the upper and lower work rolls to cause expansion of the roll diameter and alleviate convexities in the rolled strip, and to spray low-temperature coolant onto the upper and lower work rolls to cause contraction of the roll diameters and alleviate concavities in the rolled strip. On the other hand, in the rolling region in which the effect of the oil film thickness of the rolling lubrication oil including the coolant is large, the second control mode can be used to spray low-temperature coolant onto the upper and lower work rolls to increase the oil film thickness and alleviate convexities in the rolled strip, and high-temperature coolant can be sprayed onto the upper and lower work rolls to decrease the oil film thickness and alleviate concavities in the rolled strip. If convexities and concavities in the rolled strip are alleviated, anomalies in the local rate of elongation in these portions can be alleviated, and a satisfactory strip shape can be obtained.

Further, the shape control portion may switch between the two control modes based on at least one among the strip hardness of the rolled strip, the input-side strip temperature, the strip rolling speed, the work roll diameters, and the viscosity of the rolling lubrication oil.

By also considering the strip hardness of the rolled strip, the input-side strip temperature, the strip rolling speed, the work roll diameters, and the viscosity of the rolling lubrication oil, which affect the thickness of the oil film of the rolling lubrication oil including the coolant, fowled between the upper and lower work rolls and the rolled strip, still more satisfactory shape control can be performed in an extremely thin rolling region.

The second aspect of the present invention is a method of controlling the shape of a rolled strip, in which the shape in the width direction of rolled strip rolled between upper and lower work rolls is detected, and based on the detected information, a coolant is sprayed onto the upper and lower work rolls from a plurality of spray nozzles arranged along the length direction of the upper and lower work rolls; and based on the strip thickness of the rolled strip, switching is performed so that the relationship of the shape of the rolled strip to the spray quantity and/or temperature of coolant sprayed from the plurality of spray nozzles is inversely proportional, to perform shape control of the rolled strip.

By means of this invention, the roll diameters of the upper and lower work rolls expand and contract due to the thermal effect of coolant sprayed onto the upper and lower work rolls from a spray portion, so that the shape of the rolled strip can be controlled. In addition, the effect of the oil film thickness of the coolant formed between the upper and lower work rolls and the rolled strip can also be considered when controlling the shape of the rolled strip.

Effects of the Invention

By means of this invention, the following advantageous results can be obtained.

In addition to controlling the shape of rolled strip by causing expansion and contraction of the roll diameters of the upper and lower work rolls through the thermal effect of coolant sprayed onto the upper and lower work rolls from a spray portion, the effect of the oil film thickness of rolling lubrication oil including the coolant, formed between the upper and lower work rolls and the rolled strip, can also be considered when controlling the shape of the rolled strip, so that even in the region of extremely thin rolling, in which the effect of the oil film thickness of the rolling lubrication oil including the coolant is large, satisfactory shape control can be performed.

DESCRIPTION OF SYMBOLS

| | |
|---|---|
| R | Rolling mill apparatus |
| 10 | Rolling mill |
| 12 | Work roll |
| 14 | Backup roll |
| 20 | Shape detecting portion |
| 30 | Spray portion |
| 32 | Spray nozzle |
| 32A | High-temperature spray nozzle |
| 32B | Low-temperature spray nozzle |
| 40 | Control portion |
| 42 | Shape control portion |
| 44 | Spray control portion |
| P | Rolled strip |
| C | Coolant C (work roll cooling oil) |
| L | Rolling lubrication oil |

BEST MODE FOR CARRYING OUT THE INVENTION

Below, aspects of a rolling mill apparatus and a rolled strip shape control method of the present invention are explained with reference to the drawings.

Figure 1:
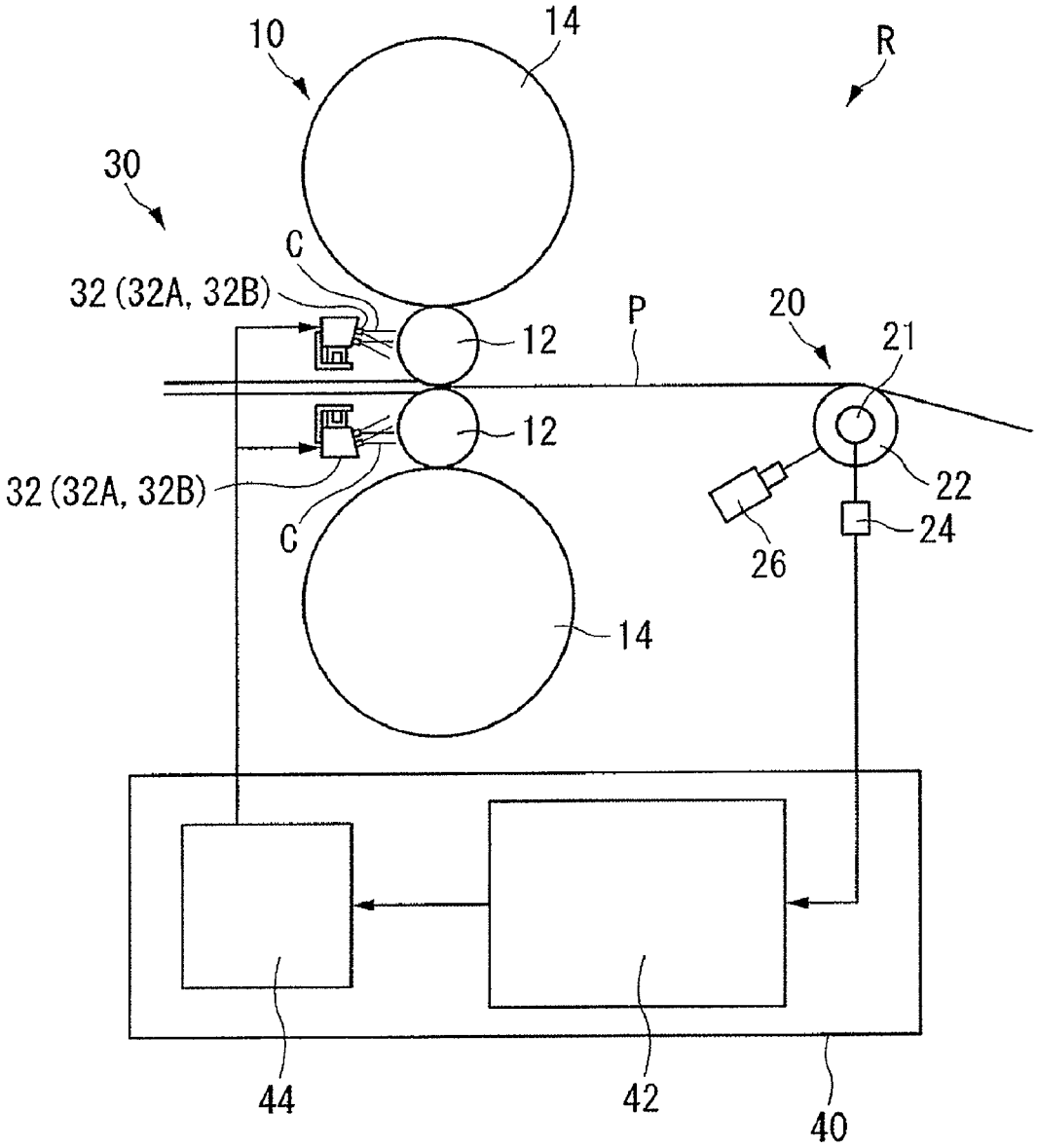
FIG. 1 is a schematic diagram showing, in summary, the configuration of rolling mill apparatus R of an aspect of the invention.

FIG. 1 is a schematic diagram showing, in summary, the configuration of a rolling mill apparatus R of an aspect of the invention.

The rolling mill apparatus R includes a rolling mill 10, which rolls the rolled strip P by means of work rolls 12; a shape detecting portion 20, which detects the degree of flatness after rolling of the rolled strip P; a spray portion 30, which sprays coolant C onto the work rolls 12 of the rolling mill 10; and a control portion 40, which comprehensively controls these portions.

Rolling lubrication oil L is supplied to the portion of contact between the work rolls 12 and the rolled strip P. The rolling lubrication oil L may be supplied from a supply portion, not shown, or may be supplied from the spray portion 30. When the rolling lubrication oil L is supplied from the spray portion 30, the coolant C also serves as the rolling lubrication oil L. The supply source (not shown) of the rolling lubrication oil L and the supply source of the coolant C may be separate, or may be integrated.

In this way, the rolling lubrication oil L supplied between the upper and lower work rolls and the rolled strip P includes the coolant C.

The rolling mill 10 is a four-stand rolling mill having upper and lower work rolls 12, and upper and lower backup rolls 14 backing up the work rolls 12. The rolled strip P is rolled between the upper and lower work rolls 12.

In this aspect, an explanation is given for a case in which a four-stand rolling mill is used as the rolling mill 10; however, this invention is not limited to such a configuration, and for example a six-stand rolling mill, or any other conventional rolling mill may be used.

The shape detecting portion 20 is provided with a plurality of rotating rotors 22 and a pressure detector 24.

The plurality of rotating rotors 22 each have a fixed width, and are adjacent and rotatably supported in a floating manner on a horizontal support shaft 21, provided on the downstream side of the rolling mill 10, by an air bearing. The total width of the rotating rotors 22 is larger than at least the width of the rolled strip P.

The pressure detector 24 detects the air pressure on the inner face of the rotating rotors 22.

By means of this configuration, the shape precision in the width direction of the rolled strip P which has been rolled by the rolling mill 10, that is, the flatness across the entire width, can be detected precisely.

Further, detected information detected by the pressure detector 24 of the shape detecting portion 20 is sent to the control portion 40.

As the shape detecting portion, a shape measuring roller such as that disclosed in Japanese Unexamined Patent Application No. 10-137831 may be used.

The spray portion 30 has a plurality of spray nozzles 32. The plurality of spray nozzles 32 are arranged along the width direction of the upper and lower work rolls 12, at equal intervals and over the same range as the width of the rotating rotors 22. By spraying the coolant C onto each of the work rolls 12 from each of the spray nozzles 32, seizing of the work rolls 12 and the like, is prevented.

Each of the spray nozzles 32 includes a high-temperature spray nozzle 32A which sprays the coolant C which has been heated by a heater, not shown, and a low-temperature spray nozzle 32*b* which sprays the coolant C which has been cooled by a cooling unit, not shown. That is, high-temperature spray nozzles 32A and low-temperature spray nozzles 32B are arranged at equal intervals along the width direction of the upper and lower work rolls 12, over the same range.

Furthermore, the spray quantity and temperature of the coolant C sprayed by each of the spray nozzles 32 of the spray portion 30 are controlled by the control portion 40.

The control portion 40 controls the rolling reduction and other quantities of the upper and lower work rolls 12 and backup rolls 14 of the rolling mill 10.

Further, the control portion 40 includes a shape control portion 42, which determines the spray quantities and temperatures of the coolant C to be sprayed from each of the spray nozzles 32 of the spray portion 30 in order to correct the shape of the rolled strip P based on a detected result of the shape detecting portion 20, and a spray control portion 44 which, based on an instruction from the shape control portion 42, controls a control valve, a heater, and a cooling unit, not shown, to cause coolant to be sprayed onto the upper and lower work rolls 12 in desired quantities and at desired temperatures from the spray portion 30.

The shape control portion 42 stores a plurality of computation methods (control modes) to determine the spray amounts and temperatures of coolant C to be sprayed from the spray portion 30 in order to correct the shape of the rolled strip P, and also performs switching between these control modes.

As a control mode, a first control mode, applied when the strip thickness of the rolled strip P is thicker than the thickness less than and equal to which the oil film thickness of the rolling lubrication oil L including the coolant C (hereafter abbreviated to "oil film thickness") influences the strip shape, and a second control mode, applied when the strip thickness of the rolled strip P is less than or equal to the thickness at which the oil film thickness influences the strip shape, are provided.

The strip thickness of the rolled strip P at which the oil film thickness is not affected is determined by at least one among the strip hardness of the rolled strip, the input-side strip temperature, the strip rolling speed, the work roll diameters, and the viscosity of the rolling lubrication oil. For example, the larger the work roll diameters, and/or the higher the viscosity of the rolling lubrication oil L, the greater the thickness at which the oil film thickness influences the strip shape. Specifically, this strip thickness is in the range of approximately 9 μm to 15 μm.

Next, shape control of the rolled strip P by the rolling mill R is explained.

By repeatedly rolling the rolled strip P, the rolling mill apparatus R forms rolled strip P of the desired strip thickness. For example, rough rolling, intermediate rolling, pre-finish rolling, and finish rolling are performed.

Specifically, by inserting a rolled strip P having a strip thickness of 2.0 mm between the upper and lower work rolls 12 and performing rolling, a strip having a strip thickness of 1.2 mm is formed. By further repeating the rolling, the strip thickness is further reduced sequentially to 0.7 mm, 0.4 mm, 0.2 mm, 0.1 mm, 0.05 mm, 0.02 mm, 0.01 mm, and 0.005 mm.

In this way, when reducing the thickness of the rolled strip P, the surface of the rolled strip P must be made flat. That is, a local swelling (a region in which the strip thickness is sufficiently thick to be equivalent to a change in shape; hereafter called a "convexity"), and a local depression (a region in which the strip thickness is sufficiently thin to be equivalent to a change in shape; hereafter called a "concavity") are formed in the surface of the rolled strip P, and so these must be corrected to make the strip flat.

To this end, high-temperature and low-temperature coolant C is sprayed onto the upper and lower work rolls 12 from the plurality of spray nozzles 32 of the spray portion 30, and by means of the thermal effect thereof; the roll diameters of the upper and lower work rolls 12 are expanded or contracted, to correct convexities and concavities formed in the surface of the rolled strip P. In this way, the shape of the rolled strip P is made flat with high precision over the entire width.

As explained above, the shape control portion 42 has two control modes. Below, an example is explained of a case in which the thickness at which the oil film thickness influences the shape is 10 μm.

The first control mode is applied when the strip thickness of the rolled strip P is greater than 10 μm. That is, for processes in which the strip thickness of the rolled strip P is rolled from 2.0 mm to 0.02 mm (thin strip region), the first control mode is applied.

The second control mode is applied when the strip thickness of the rolled strip P is equal to or less than 10 μm. That is, in rolling processes to reduce the strip thickness of the rolled strip P from 0.02 mm to 0.01 mm, and further from 0.01 mm to 0.005 mm (extremely thin strip region), the second control mode is applied.

That is, the shape control portion 42 switches the control mode from the first control mode to the second control mode upon performing rolling treatment to reduce the strip thickness of the rolled strip P from 0.02 mm to 0.01 mm.

Figure 2A:
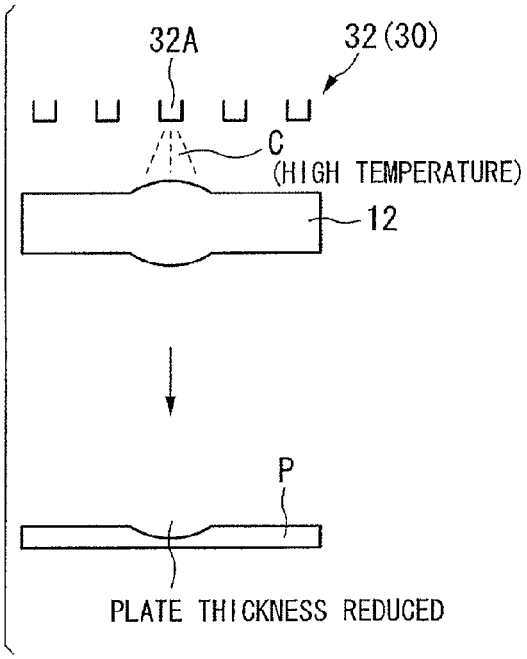
FIG. 2A is a diagram explaining the relationship between the coolant C sprayed from the spray portion 30 and the shape of the rolled strip P for correcting the shape of the rolled strip P in a first control mode.
Figure 2B:
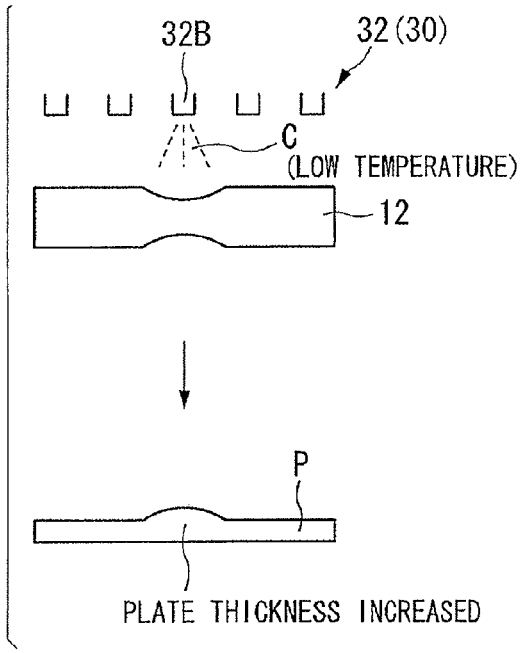
FIG. 2B is a diagram explaining the relationship between the coolant C sprayed from the spray portion 30 and the shape of the rolled strip P for correcting the shape of the rolled strip P in the first control mode.
Figure 3A:
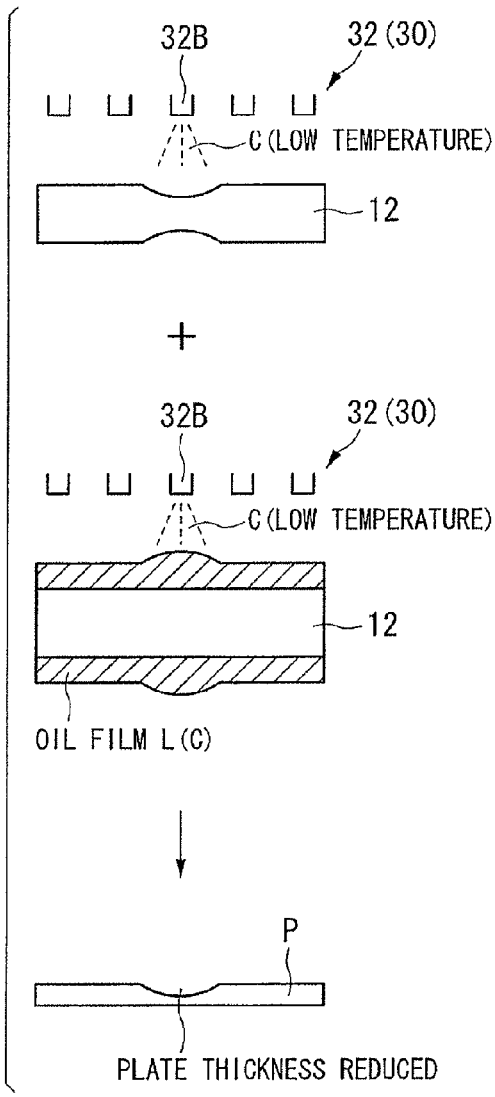
FIG. 3A is a diagram explaining the relationship between the coolant C sprayed from the spray portion 30 and the shape of the rolled strip P for correcting the shape of the rolled strip P in a second control mode.
Figure 3B:
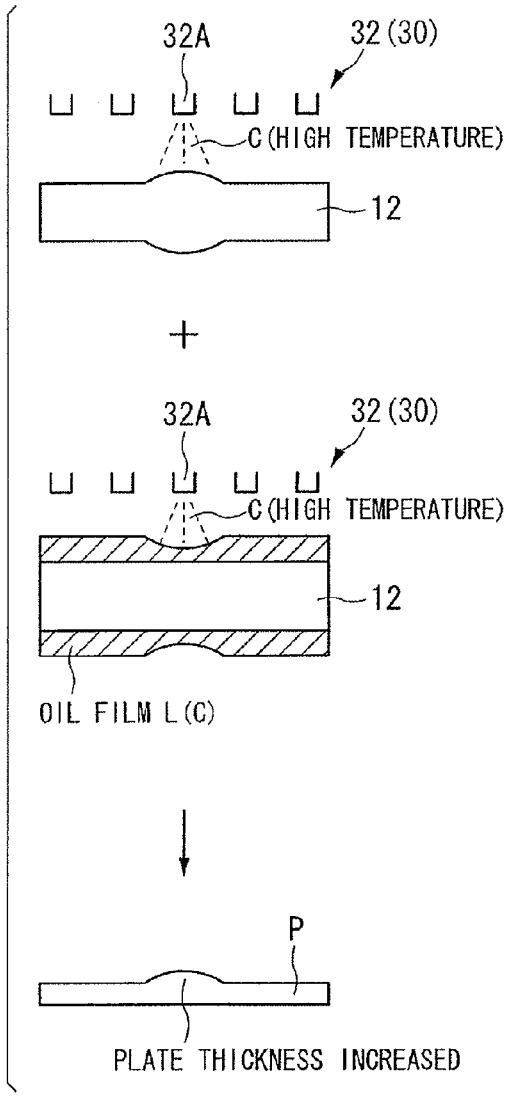
FIG. 3B is a diagram explaining the relationship between the coolant C sprayed from the spray portion 30 and the shape of the rolled strip P for correcting the shape of the rolled strip P in the second control mode.

FIG. 2A, FIG. 2B, FIG. 3A, and FIG. 3B are schematic diagrams explaining the relationship between the coolant C sprayed from the spray portion 30 and the shape of the rolled strip P when the shape of the rolled strip P is corrected. FIG. 2A and FIG. 2B show the case of the first control mode, and FIG. 3A and FIG. 3B show the case of the second control mode.

When the first control mode is applied, shape correction of the rolled strip P is performed as follows.

As shown in FIG. 2A, when the shape detecting portion 20 detects a region of local swelling (a convexity) in the surface of the rolled strip P, under control of the shape control portion 42, high-temperature coolant C is sprayed onto the upper and lower work rolls 12 from the spray portion 30. The quantity of work rolls cooling oil C sprayed onto the region of the upper and lower work rolls 12 corresponding to the convexity in the surface of the rolled strip P increases.

By this means, the roll diameters of the upper and lower work rolls 12 undergo partial thermal expansion (enlargement), the rolling reduction of the convexity in the surface of the rolled strip P increases, and the surface is flattened.

Conversely, when as shown in FIG. 2B the shape detecting portion 20 detects a local depressed portion (a region in, which the strip thickness is reduced (concavity)) in the surface of the rolled strip P, under control of the shape control portion 42, low-temperature coolant C is sprayed onto the upper and lower work rolls 12 from the spray portion 30. The quantity of coolant C sprayed onto the region of the upper and lower work rolls 12 corresponding to the concavity in the surface of the rolled strip P increases.

By this means, the roll diameters of the upper and lower work rolls 12 undergo partial thermal contraction (reduction), the rolling reduction of the concavity in the surface of the rolled strip P decreases, and the surface is flattened.

In this way, convexities and concavities in the surface of the rolled strip P are evened (the depth of concavities and the height of convexities are reduced), the strip elongation distribution is rendered uniform, and the surface is flattened.

The spraying quantity and temperature of the coolant C are determined by the shape control portion 42 according to the extent of the convexities and concavities formed in the surface of the rolled strip P and other factors.

The above control method, that is, the rolling method in which the first control mode is applied, is the same as control methods employed in the prior art.

However, if the rolling method in which the first control mode is applied is employed when the strip thickness of the rolled strip P is 10 μm or less, then it becomes difficult to flatten the surface shape of the rolled strip P. This is because the oil film thickness formed between the upper roll 12 and the rolled strip P, and between the lower work rolls 12 and the rolled strip P greatly affects the surface shape of the rolled strip P.

Normally, the oil film thickness formed between the upper roll 12 and the rolled strip P, and between the lower work rolls 12 and the rolled strip P is approximately 1 μm. Hence, even when there is some degree of change in the thickness of the oil film, because of the large strip thickness of the rolled strip P, the change in oil film thickness has almost no effect on the surface shape of the rolled strip P, that is, on flatness.

However, when the strip thickness of the rolled strip P is 10 μm or less, when the oil film thickness changes, there is a large effect on flatness of the surface shape of the rolled strip P.

The relationship between changes in the oil film thickness and the surface shape of the rolled strip P is as follows.

The viscosity of rolling lubrication oil L is known to change with the oil temperature. Specifically, when the rolling lubrication oil L is at a high temperature, the viscosity falls, so that the oil film thickness tends to be decreased partially. Also, the friction coefficient also increases. As a result, the rolling reduction of the rolled strip P decreases, and the strip thickness of the rolled strip P increases locally.

On the other hand, when the rolling lubrication oil L is at low temperature, the viscosity rises, so that the oil film thickness increases partially. Moreover, the friction coefficient decreases. As a result, the rolling reduction of the rolled strip P increases, and the strip thickness of the rolled strip P decreases locally.

However, the coolant C affects not only the temperature of the work rolls 12, but also the temperature of the rolling lubrication oil L. That is, the temperature of the rolling lubrication oil L is affected by the temperature of the coolant C, such that the higher the temperature of the coolant C, the higher the temperature of the rolling lubrication oil L, and the lower the temperature of the coolant C, the lower the temperature of the rolling lubrication oil L.

Further, because the coolant C sprayed onto the work rolls 12 thereafter becomes rolling lubrication oil L, increasing the spraying amount of the sprayed coolant C causes an increase in the quantity of the rolling lubrication oil C, and reducing the spraying amount of the coolant C causes a decrease in the quantity of the rolling lubrication oil L.

That is, when the strip thickness of the rolled strip P is equal to or less than 10 μm, the relationship between the surface shape (flatness) of the rolled strip P and the sprayed amount and temperature of the coolant C sprayed onto the upper and lower work rolls 12 from the spray portion 30 is inversely proportional to the relationship when the strip thickness is approximately 10 μm or greater.

When the strip thickness of the rolled strip P is 10 μm or less, the control mode which takes into consideration the change in oil film thickness of the rolling lubrication oil L including the coolant C, that is, the second control mode, is applied.

When the second control mode is applied, shape correction of the rolled strip P is performed as follows.

As shown in FIG. 3A, when a portion of local swelling (convexity) in the surface of the rolled strip P is discovered by the shape detecting portion 20, under a control of the shape control portion 42, low-temperature coolant C is sprayed onto the upper and lower work rolls 12 from the spray portion 30. The amount of coolant C sprayed onto the region of the upper and lower work rolls 12 corresponding to the convexity in the surface of the rolled strip P increases. By this means, the roll diameters of the upper and lower work rolls 12 undergo partial thermal contraction (reduction).

On the other hand, the thickness of the oil film formed between the upper and lower work rolls 12 and the rolled strip P partially increases.

Hence when the increase in the oil film thickness is larger than the decrease in roll diameter of the upper and lower work rolls 12, the rolling reduction of the convexity in the surface of the rolled strip P increases, and the surface is flattened.

Conversely, as shown in FIG. 3B, when a locally depressed portion (concavity) in the surface of the rolled strip P is detected by the shape detecting portion 20, under control of the shape control portion 42, the high-temperature coolant C is sprayed onto the upper and lower work rolls 12 from the spray portion 30. The amount of coolant C sprayed onto the region of the upper and lower work rolls 12 corresponding to the concavity in the surface of the rolled strip P increases. By this means, the roll diameters of the upper and lower work rolls 12 undergo partial thermal expansion (enlargement).

On the other hand, the thickness of the oil film formed between the upper and lower work rolls 12 and the rolled strip P partially decreases.

Hence when the decrease in oil film thickness is greater than the increase in roll diameter of the upper and lower work rolls 12, the rolling reduction of the concavity in the surface of the rolled strip P decreases, and the surface is flattened.

In this way, for rolled strip P of strip thickness 10 μm or less, by inverting the strip shape control method of the prior art with respect to the spraying amount and temperature of the coolant C sprayed onto the upper and lower work rolls 12, convexities and concavities in the surface of the rolled strip P can be evened (the depths of concavities and heights of convexities can be reduced), and the strip elongation distribution can be made uniform, so that the surface can be flattened satisfactorily.

The spraying amount and temperature of the coolant C are determined in the shape control portion 42 according to the extent of the convexity or concavity (protrusion amount, depression amount, or similar) formed in the surface of the rolled strip P, the strip thickness of the rolled strip P, and other factors.

As explained above, by means of rolling mill apparatus R of this aspect, in addition to control of the shape of the rolled plate in which the roll diameters of the upper and lower work rolls expanded or contracted by the thermal effect of the coolant C sprayed from the spray portion 30 onto the upper and lower work rolls 12, by also taking into consideration the effect of the thickness of the oil film formed between the upper roll 12 and the rolled strip P, and between the lower work rolls 12 and the rolled strip P, satisfactory control of the shape of the rolled strip P is possible.

In particular, in an extremely thin rolling region (thicknesses at which the oil film thickness of the coolant influences the strip shape: strip thicknesses of approximately 9 μm or greater and 15 μm or less), at which the effect of the oil film thickness is large, satisfactory shape control is possible.

In the above-described aspect, the operation procedure, the shapes and combinations of constituent members, and the like are merely examples, and various modifications are possible based on the process conditions and design requirements, without deviating from the gist of the invention.

In the above-described aspect, a case was explained in which a four-stand rolling mill is used as the rolling mill 10; but the invention is not limited to such a rolling mill. Moreover, a plurality of rolling mills 10 may be arranged, in a multi-stage rolling mill apparatus which performs continuous rolling.

In the rolling process of the rolled strip P in the above-described aspect, a case was explained of switching from the first control mode to the second control mode; but other configurations are possible. It is sufficient that the control mode be switched according to the strip thickness of the rolled strip P, and so there may be cases of switching from the second control mode to the first control mode as well.

Further, in the above-described aspect, a case was explained in which the spray portion 30 is provided on the upstream side of the work rolls 12, and the spray amount and temperature of the coolant C sprayed therefrom are adjusted; but other configurations are possible.

For example, the spray portion 30 may be provided on the downstream side of the work rolls 12. Or, the spray portion 30 may be provided on both the upstream side and the downstream side.

Further, the invention is not limited only to cases in which each of the spray nozzles 32 of the spray portion 32 includes a high-temperature spray nozzle 32A and a low-temperature spray nozzle 32B. A configuration is possible in which the temperature of the coolant C sprayed from each spray nozzle 32 can be adjusted according to a requirement.

Further, in addition to high-temperature spray nozzles 32A and low-temperature spray nozzles 32B, intermediate-temperature spray nozzles which spray intermediate-temperature coolant C may also be employed.

In the above-described aspect, a case was explained of switching the control mode when the strip thickness of the rolled strip P is a prescribed thickness (approximately 10 μm); but other configurations are possible. The strip thickness may be in the range of approximately 9 μm and 15 μm.

In addition to the strip thickness of the rolled strip P, at least one of the strip hardness of the rolled strip P, the input-side strip temperature, the strip rolling speed, the work roll diameters, and the viscosity of the rolling lubrication oil, may also be considered, to switch between the first control mode and the second control mode.

It is desirable that optimum numerical values to be determined for the relationships of the strip thickness of the rolled strip P, the strip hardness, the input-side strip temperature, the strip rolling speed, the work roll diameters, and the viscosity of the rolling lubrication oil, by repeatedly performing rolling treatment.

INDUSTRIAL APPLICABILITY

By means of a rolling mill apparatus and the method of shape control of rolled strip of the present invention, satisfactory shape control is possible even in an extremely thin rolling region, in which the effect of the oil film thickness of the rolling lubrication oil, including the coolant on shape control, is large.

The invention claimed is:

1. A rolling mill apparatus, comprising:

a rolling mill, which rolls a rolled strip between upper and lower work rolls placed opposite each other;

a shape detecting portion, which detects a degree of flatness of the rolled strip in a width direction of said rolled strip which has been rolled by said rolling mill;

a spray portion, having a plurality of spray nozzles arranged along a length direction of said upper and lower work rolls, which sprays said upper and lower work rolls with coolant; and a shape control portion configured to control at least one of a spray amount and temperature of the coolant sprayed from said spray portion based on detected information from said shape detecting portion, to control the shape of said rolled strip; wherein said shape control portion is configured to have two control modes to be used to control at least one of the spray amount and temperature, said shape control portion is configured to switch between said two control modes based on a strip thickness of said rolled strip, and each of said two control modes in which the relationship between the detected information of said shape detecting portion and at least one of the spray amount and temperature of the coolant sprayed from said spray portion is inverse to the other mode.

2. The rolling mill apparatus according to claim 1, wherein said shape control portion switches between said two control modes when said rolled strip is rolled to a strip thickness equal to or less than a thickness at which the oil film thickness of the rolling lubrication oil including said coolant, influences the strip shape.

3. The rolling mill apparatus according to claim 1, wherein said spray portion is provided with a high-temperature spray nozzle and a low-temperature spray nozzle which spray a coolant at different temperatures; and said shape control portion has a first control mode in which, when a convexity formed in said rolled strip is detected, said shape control portion increases the spraying quantity from said high-temperature spray nozzle, and when a concavity formed in said rolled strip is detected, said shape control portion increases the spraying quantity from said low-temperature spray nozzle, and a second control mode in which, when a convexity formed in said rolled strip is detected, said shape control portion increases the spraying quantity from said low-temperature spray nozzle, and when a concavity formed in said rolled strip is detected, said shape control portion increases the spraying quantity from said high-temperature spray nozzle.

4. The rolling mill apparatus according to claim 2, wherein said shape control portion switches between said two control modes based on at least one among strip hardness of said rolled strip, an input-side strip temperature, a strip rolling speed, work roll diameters, and a viscosity of the rolling lubrication oil.

5. A method of rolled strip shape control, comprising:

a step of detecting a shape in a width direction of a rolled strip which has been rolled between upper and lower work rolls;

a step of spraying coolant onto said upper and lower work rolls from a plurality of spray nozzles arranged along a length direction of said upper and lower work rolls, based on detected information in the step of detecting; and a step of switching two control modes to be used to control at least one of a spray amount and temperature of the coolant sprayed from said plurality of spray nozzles based on a strip thickness of said rolled strip in order to control the shape of said rolled strip, wherein each of said two control modes in which the relationship between the detected information in the step of detecting and at least one of the spray amount temperature of the coolant sprayed from said plurality of spray nozzles is inverse to the other mode.

6. The rolling mill apparatus according to claim 2, wherein said spray portion is provided with a high-temperature spray nozzle and a low-temperature spray nozzle which spray a coolant at different temperatures; and said shape control portion has a first control mode in which, when a convexity formed in said rolled strip is detected, said shape control portion increases the spraying quantity from said high-temperature spray nozzle, and when a concavity formed in said rolled strip is detected, said shape control portion increases the spraying quantity from said low-temperature spray nozzle, and a second control mode in which, when a convexity formed in said rolled strip is detected, said shape control portion increases the spraying quantity from said low-temperature spray nozzle, and when a concavity formed in said rolled strip is detected, said shape control portion increases the spraying quantity from said high-temperature spray nozzle.

* * * * *